US006705462B2

(12) United States Patent
Kasuya

(10) Patent No.: US 6,705,462 B2
(45) Date of Patent: Mar. 16, 2004

(54) CAP FOR CONTENTS MIXER

(75) Inventor: Shoji Kasuya, Kanagawa (JP)

(73) Assignee: Mikuni Corporation, Odawara (JP)

( * ) Notice: Subject to any disclaimer, the term of this patent is extended or adjusted under 35 U.S.C. 154(b) by 33 days.

(21) Appl. No.: 10/050,558

(22) Filed: Jan. 18, 2002

(65) Prior Publication Data

US 2002/0096440 A1 Jul. 25, 2002

(30) Foreign Application Priority Data

Jan. 23, 2001 (JP) ..... 2001-014447

(51) Int. Cl.[7] ..... B65D 25/08
(52) U.S. Cl. ..... 206/222; 215/DIG. 8
(58) Field of Search ..... 206/219, 222; 215/DIG. 8; 222/541.2, 541.5, 81, 83

(56) References Cited

U.S. PATENT DOCUMENTS

| | | | | |
|---|---|---|---|---|
| 4,874,102 A | | 10/1989 | Jessop et al. | |
| 5,950,819 A | * | 9/1999 | Sellars | 206/221 |
| 6,170,654 B1 | * | 1/2001 | Gartner et al. | 206/219 |
| 6,171,293 B1 | * | 1/2001 | Rowley et al. | 604/403 |
| RE38,067 E | * | 4/2003 | Gueret | 206/222 |

FOREIGN PATENT DOCUMENTS

| | | |
|---|---|---|
| JP | 52-51103 | 11/1977 |
| JP | 7-38155 | 8/1995 |

* cited by examiner

*Primary Examiner*—Shian Luong
(74) *Attorney, Agent, or Firm*—Birch, Stewart, Kolasch & Birch, LLP

(57) ABSTRACT

There is provided a cap for a contents mixer that is capable of, with a simple operation, storing a first contents and another contents in isolation from one another until they are needed, and of mixing the at least two contents together when necessary. To this end, a cap for the contents mixer is attached to an opening section of a container body. The cap comprises a cap main body with a first contents storage tube. The first contents storage tube having a thin bottom that is sealed, yet capable of being opened. The storage tube is suspended from a lower surface of a top wall of the cap main body. The first contents storage tube further is formed with an engagement section for attaching it to an opening section of the container main body at an inner surface. A cutting tube is also included with a blocked head section and the cutting tube has a flange section formed at an outer periphery of the head section. The cutting tube is engaged inside the first contents containing tube in a watertight manner and is capable of sliding therein. Also included is a substantially U-shaped stopper that is interposed between the flange section of the cutting tube and the top wall of the cap main body.

10 Claims, 4 Drawing Sheets

CAP FOR CONTENTS MIXER

BACKGROUND OF THE INVENTION

1. Field of the Invention

The present invention relates generally to a cap for a contents mixer. In particular, an exemplary embodiment of this invention relates to a cap that can fit onto a container, and preferably a cap for a contents mixer used for storing a first contents inside the cap, and the first contents in the cap is capable of being mixed with different kinds of contents stored in a container's main body when required.

2. Description of Related Art

Conventionally, it has been difficult to preserve various types of substances, such as medicines, food and drink, adhesives etc. in a state where a number of the components are mixed together in advance. In this type of situation, it is necessary to keep each component separately, and only mix them together at the time of use.

For example, Utility Model Laid-open No. Sho. 52-51103 discloses a two liquid mixture container where the two types of contents are kept in a single container, and are mixed together at the time of use. In this container, there is a storage tube for one component that is separated from the container main body by a thin film inside the cap. By opening up the thin film, one of the components is conveyed into the container's main body and mixes with the other component already situated inside the container's main body.

This two liquid mixture container has a ring for preventing lowering of the cap. This ring has a gripping piece, interposed between a lower end surface of the cap and a container shoulder. This arrangement of the ring prevents the thin film from being opened up when not required. However, at the time of mixing, the gripping piece is tensioned to disconnect the ring at a thinner cut-away section of the ring, which was formed in advance. After the ring has been removed, the thin film is cut open.

However, when a solution is mixed using a two liquid mixture container with a cap lowering prevention ring, it is first of all necessary to disconnect the ring. In order to make this disconnection simple, it is necessary to take steps such as cutting a slot or notch along the radial direction of the ring in advance. Hence, taking these additional steps complicates the manufacturing process.

Since it is also necessary to provide the gripping piece on the ring in order to disconnect the ring, the overall shape of the device is also complicated to make. For example, the gripping piece juts out from the cap, and the whole item becomes bulky. For this reason, in the case where containers are lined up parallel to each other, it becomes necessary to keep a space for the jutting out gripping piece, thus lining up the containers close to each other is made more difficult.

In addition, to disconnect the ring it is necessary to apply tension to the gripping piece. However, in practical terms, considerable force is required to disconnect the ring, creating cases whereby the person applying the force makes a mistake and turns the container itself over. In a worst case scenario the contents of the container may be tipped out.

SUMMARY OF THE INVENTION

The present invention has been developed with the view to substantially solving the above described problems. The object of the invention is to provide a cap for a contents mixer that can keep at least two components apart from each other reliably until such time as they are mixed. In addition, the cap can reliably mix the at least two components with a simple operation at the time of mixing, without a bulky apparatus, and includes a simple method of manufacture.

In accordance with a first exemplary embodiment of the present invention, a cap for a contents mixer is attached to an opening section of a container body. The cap comprises a cap main body having a first contents storage tube. The first contents storage tube has a thin bottom that is sealed but is capable of being opened. The first contents storage tube is suspended from a lower surface of a top wall of the cap main body. The first contents storage tube is further formed with an engagement section for attaching the first contents storage tube to an opening section of the container main body at an inner surface. The first contents storage tube is also formed with a cutting tube. The first contents storage tube blocks a head section of the cutting tube. The first contents storage tube further has a flange section formed at an outer periphery of the cutting tube's head section. The flange section is engaged in the inside of the first contents storage tube in a watertight manner and is capable of sliding in relationship with the first contents storage tube. In addition, a substantially U-shaped stopper is interposed between the flange section of the cutting tube and the top wall of the cap main body.

In accordance with a second exemplary embodiment of the present invention, a cap for a contents mixer is the same as the first embodiment, wherein a projection for reducing a detachment force of the cap contacts the flange section at a lower surface and is formed on an upper surface of the stopper.

In accordance with a third exemplary embodiment of the present invention, a cap for a contents mixer is the same as the first or second embodiments, wherein a projection for preventing detachment of the cap and for engaging the cap with the first contents storage tube is formed on an opening inner wall of the stopper.

In accordance with a fourth exemplary embodiment of the present invention, a cap for a contents mixer is the same as any one of the first to third embodiments, wherein the stopper has an open-ended square cross-section with a lower surface opened.

These and other features and advantages of this invention are described in or are apparent from the following detailed description of this invention.

BRIEF DESCRIPTION OF THE DRAWINGS

Various exemplary embodiments of this invention will be described in detail, with reference to the following figures, wherein.

DETAILED DESCRIPTION OF THE PREFERRED EMBODIMENTS

Figure 1:
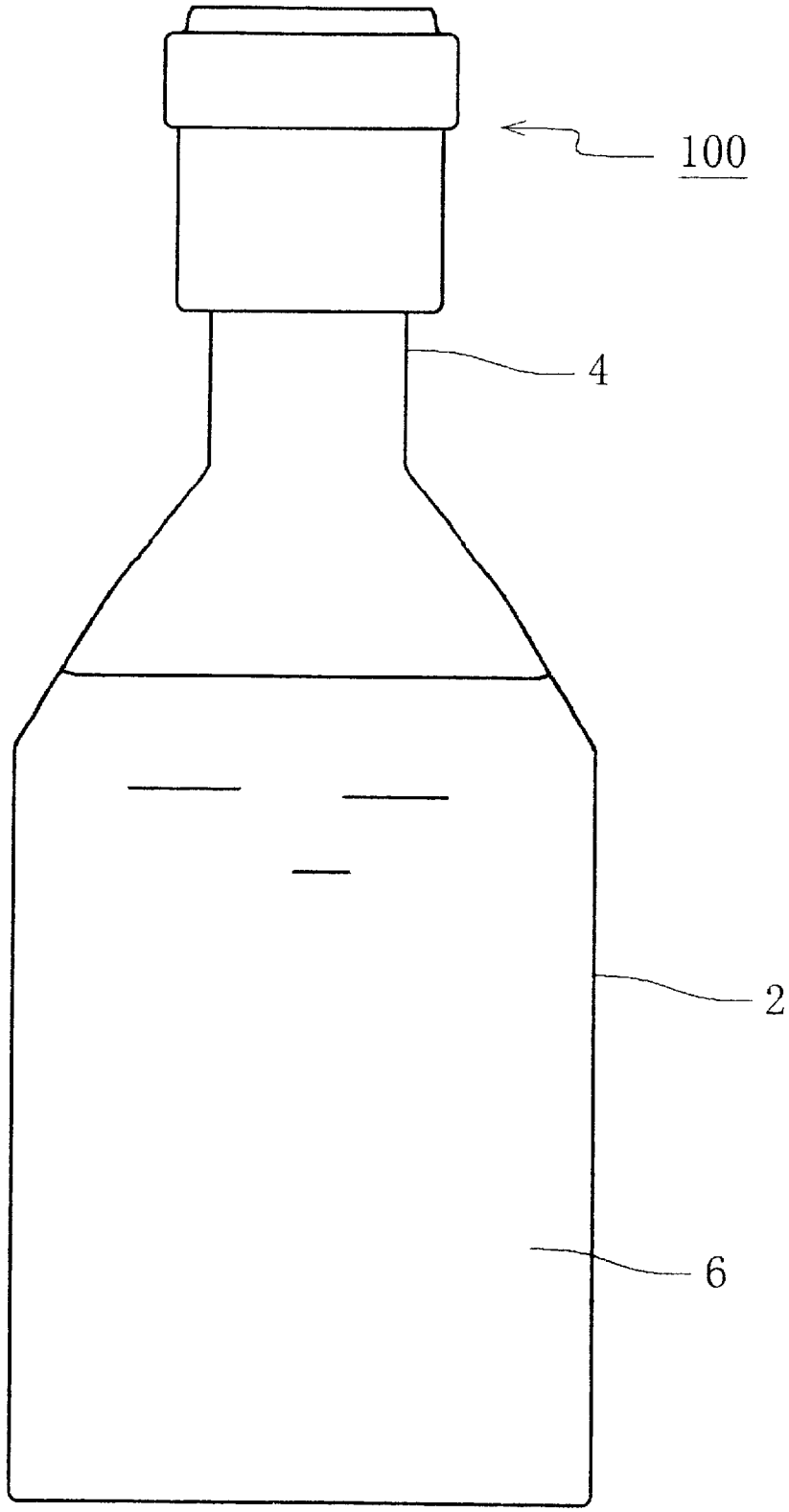
FIG. 1 illustrates an exemplary embodiment of a view showing the state where a cap is attached to a container main body in accordance with the systems and methods of the invention.

For a general understanding of the features of the present invention, reference is made to the drawings, wherein like reference numerals have been used throughout to identify identical or similar elements. While the present invention will be described in terms of an illustrative embodiment or embodiments, it will be understood that the invention is adaptable to a variety of contents mixers, such that the present invention is not necessarily limited to the particular embodiment or embodiments shown and described herein. To the contrary, the following description is intended to cover all alternatives, modifications, and equivalents, as may be included within the spirit and scope of the invention. Within the description of the present invention, the terms contents, substances and components are used interchangeably. The present invention will now be described in detail below with reference to the drawings.

FIG. 1 illustrates an example of a cap 100 for a contents mixer in accordance with the present invention. The cap 100 is formed of synthetic resin and fitted to an opening part 4 of a container body 2. At least one of the contents, not shown, is stored inside the cap 100 for the mixing container. The other contents 6 (in this example, a liquid) are stored inside the container main body 2. In the present invention, the first contents located inside the cap 100 and the other contents 6 that are stored in the container body 2 are isolated from one another, as will be described in detail later. The isolated contents are mixed together when required.

Figure 2B:
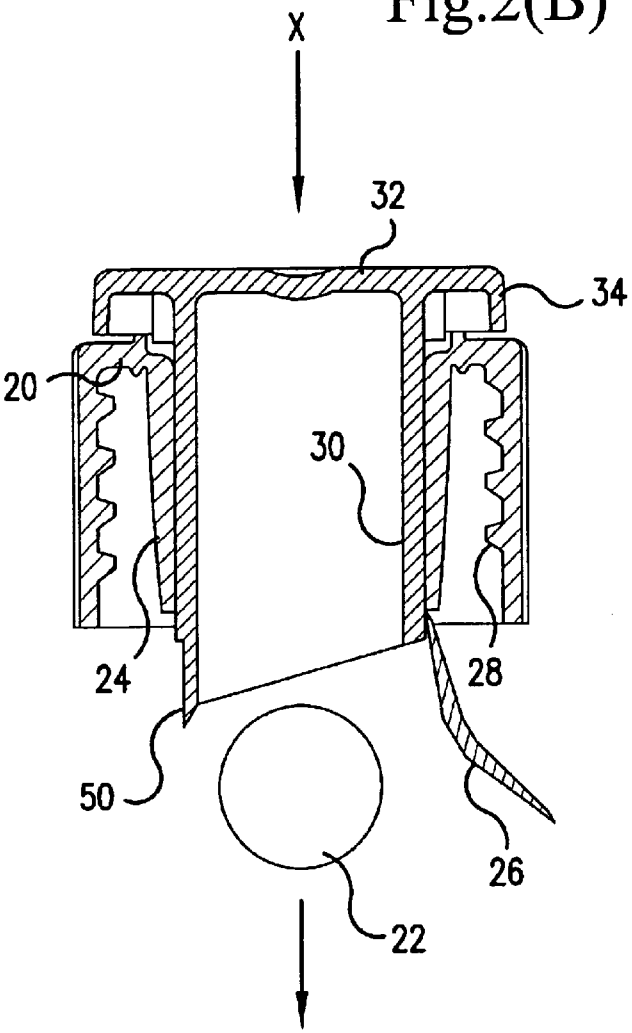
FIG. 2(B) illustrates an exemplary embodiment of a sidewise cross sectional view showing the structure of the cap at the time of contents mixing in accordance with the systems and methods of the present invention.
Figure 2A:
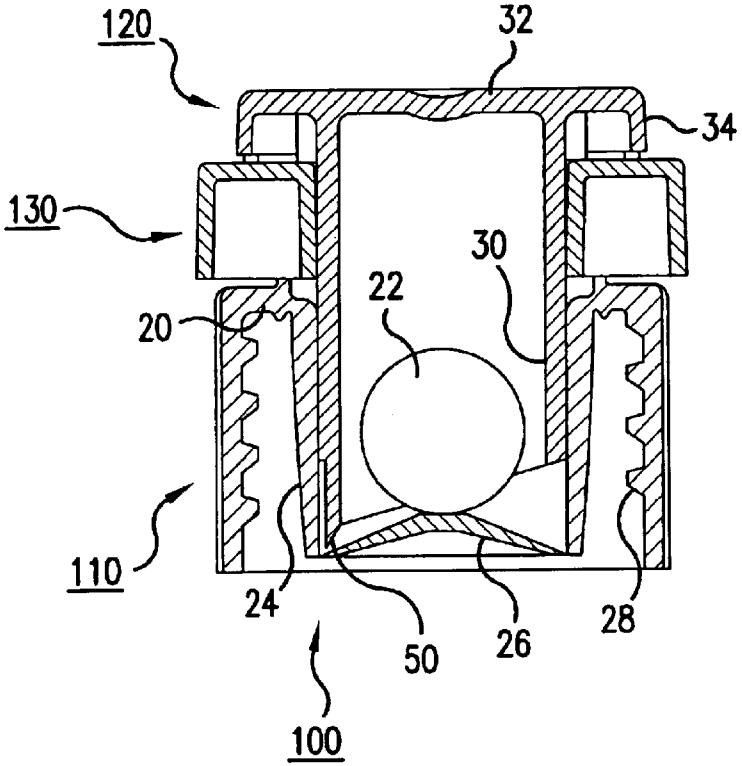
FIG. 2(A) illustrates an exemplary embodiment of a sidewise cross sectional view showing the structure of the cap before contents mixing in accordance with the systems and methods of the invention.

FIG. 2 illustrates the cross sectional structure of the cap 100 for a contents mixer of the present invention, with FIG. 2(A) illustrating the state of the cap 100 before mixing and FIG. 2(B) illustrating the state of the cap 100 after mixing.

In particular, FIG. 2(A) illustrates a cylindrical cap main body 110, with an upper end blocked off by a top wall 20. The cylindrical cap main body 110 also includes a storage tube 24 for holding a first contents 22 hanging inside the cap main body 110 from a lower surface of the top wall 20.

A thin bottom 26, which is sealed but can be cut open, is stretched across the lower end of the storage tube 24. The lower end of the storage tube 24 is thereby sealed-off by this thin bottom 26.

An engagement section 28, i.e., a screw, is formed in an inner surface of the cap main body 110, and fitted to the opening section of the container main body 2 using the engagement section 28.

A cutting tube 120, and a lower end side 30 of the cutting tube 120 is engaged inside the storage tube 24 in a watertight manner so as to be capable of sliding within the storage tube. Also, a head section 32 of the cutting tube 120 is blocked off, and a flange 34 is formed on the outer periphery of the head section 32.

Figure 3A:
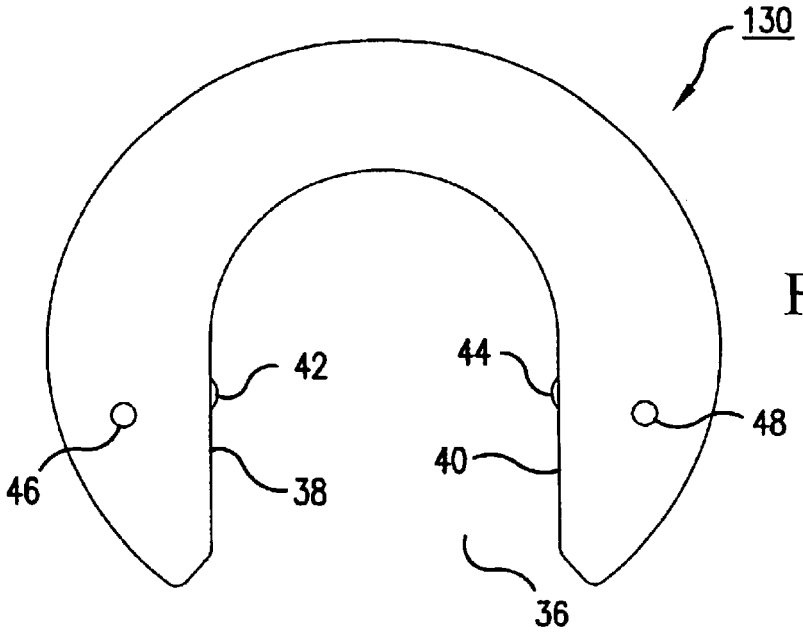
FIG. 3(A) illustrates an exemplary embodiment of a plane view showing the structure of a stopper in accordance with the systems and methods of the present invention.

A stopper 130 is inserted between the flange 34 of the cutting tube 120 and the top wall 20 of the cap main body 110. The stopper 130, as shown in FIG. 3(A) (plan view), is substantially U-shaped, with a U-shaped opening section 36 formed facing inwards, and a pair of detachment prevention projections 42 and 44 are formed opposite to each other on opposite opening inner walls 38 and 40. Similarly, a pair of detachment force reduction projections 46 and 48 are formed on opening sides of the upper surface of the stopper 130.

Figure 3B:
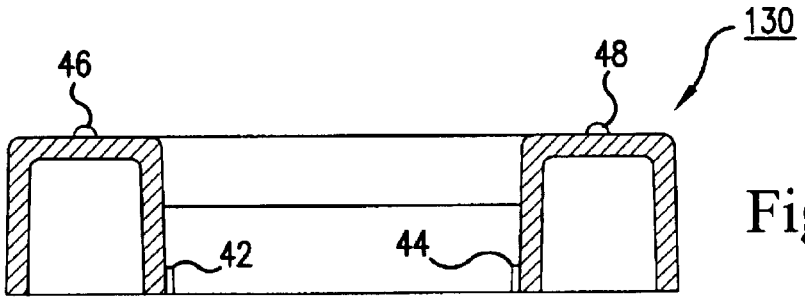
FIG. 3(B) illustrates an exemplary embodiment of a sidewise cross sectional view showing the structure of a stopper in accordance with the systems and methods of the present invention.
Figure 3C:
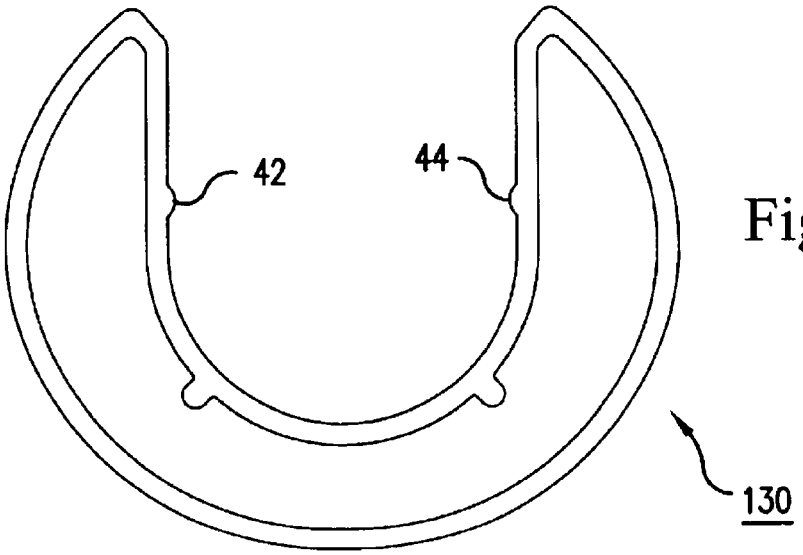
FIG. 3(C) illustrates an exemplary embodiment of a reverse view showing the structure of a stopper in accordance with the systems and methods of the present invention.

The stopper 130, as shown in FIG. 3(B) (sidewise cross-section) and FIG. 3(C) (reverse view), has a structure wherein a thinned notch having an open-ended square shape cross-section opens out in a downward direction.

Figure 4A:
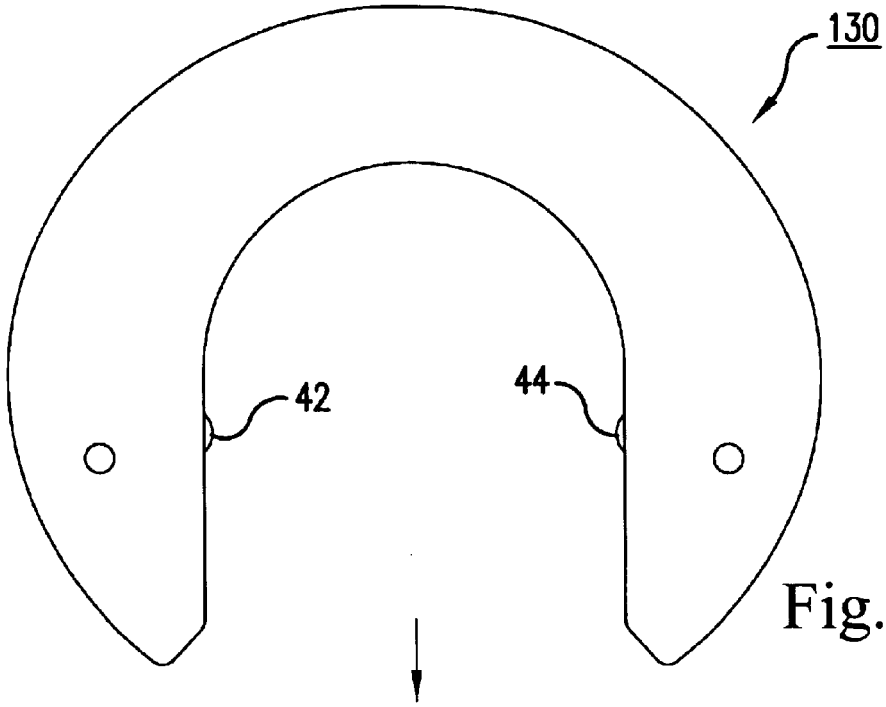
FIG. 4 illustrate an exemplary embodiment of a plane view showing a state where the stopper is attached to the cap in accordance with the systems and methods of the present invention.
Figure 4B:
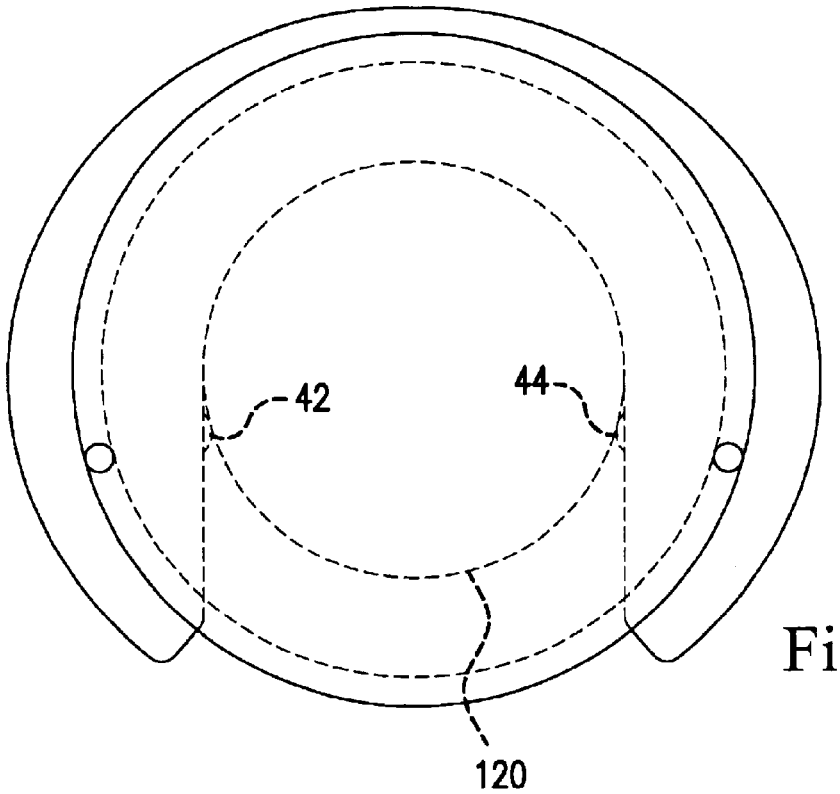

FIG. 4 illustrates the state with the stopper 130 inserted into the cap. The stopper 130 in this case abuts with the cutting tube 120 using the detachment prevention projections 42 and 44. In a normal handling state, detachment of the cap 100 will be prevented.

Next, using FIGS. 2(A)–(B), the case will be described where the first contents 22 stored inside the cap 100 and the other contents 6 stored in the container main body 2 are mixed together using the container main body 2 fitted with the cap 100 as illustrated in FIG. 1.

Before mixing, as shown in FIG. 2(A), the first contents 22 is kept isolated from the other contents 6 by the thin bottom 26, and the two are not mixed. At the time of mixing, as shown in FIG. 2(B), firstly, the stopper 130 is withdrawn from the cap 100. Then the cutting tube 120 is pressed in the downward direction (the direction of arrow X). In this way, the lower end 50 of the cutting tube 24 is pressed downward, the thin bottom 26 is cut open along the shape of the lower end of the cutting tube 120, and then the first contents 22 stored in the storage tube 24 drops down into the container main body 2. As a result, the contents 6 and 22 are mixed.

In the above described structure, the cap is made of resin, but this is not limiting because the cap can be made of various materials, such as rubber, metal or the like. Also, although the engagement section 28 formed as a screw is formed on the inner periphery of the cap main body 110, this is not limiting, and it is possible, for example, to fit the engagement section 28 by utilizing the elasticity of the resin itself, thereby attaching the cap main body 110 to the container main body 2 by crimping with a metal structure. Further, although the stopper 130 is formed with an open-ended square cross-section, this is not limiting, because the stopper 130 may also be constructed so as to fit tightly with the inner section. It is also possible for the first contents 22 stored in the storage tube 24 to be any of a liquid, powder, or gas.

In the present invention, since the first contents 22 is stored inside a cap 100 and is isolated from the other contents 6 stored in the container main body 2 by a thin bottom 26, it is possible to store the contents 6, 22 for a prolonged period of time without the contents 6, 22 being mixed. However, when it becomes necessary to mix the contents 6, 22 together, the stopper 130 is withdrawn, i.e., by simply pressing the cutting tube 120 downwards the contents 6, 22 are rapidly mixed together. This operation is very simple to do.

Accordingly, the present invention is convenient for storing substances that will deteriorate if mixed beforehand. In the event that the detachment preventing projections 42 and 44 are provided on the stopper 130, it is possible to reliably prevent the stopper 130 from being detached from the cap 100 by accident. In the case where the stopper 130 is made with a notch, it becomes easy for an opening section inner wall 38 and 40 of the stopper 130 to bend, and for this reason there is no need for a substantial amount of force to withdraw the stopper 130, i.e., the stopper 130 can be withdrawn easily. Still further, in the event detachment force reduction projections 46 and 48 are formed on the upper surface of the stopper 130, there is the advantage that the stopper 130 can be simply withdrawn from the cap 100 without the need for a substantial amount of force.

The invention has been described with particularity in connection with the embodiments. However, it should be appreciated that many alternatives, modifications and variations may be made to the embodiments of the invention without departing from the spirit and inventive concepts contained herein. Accordingly, the present invention is intended to embrace all such alternatives, modifications, and variations. Thus, various changes may be made without departing from the spirit and scope of the invention as defined in the following claims.

What is claimed is:

1. A cap for a contents mixer attached to an opening section of a container main body, comprising:

a cap main body with a first contents storage tube, the first contents storage tube having a thin bottom that is sealed and is capable of being opened, the first contents storage tube being suspended from a lower surface of a top wall of the cap main body, the cap main body including an engagement section for attaching the cap main body to an opening section of the container main body at an inner surface;

a cutting tube with a blocked head portion and having a flange section formed at an outer periphery of the head portion, the cutting tube engaging inside the first contents storage tube in a water tight manner while being capable of sliding therein; and a stopper interposed between the flange section the cutting tube and the top wall of the cap main body.

2. The cap for a contents mixer of claim 1, further comprising a projection for reducing detachment force of the cap, the projection for reducing detachment force contacting a lower surface of said flange and formed on an upper surface of the stopper.

3. The cap for a contents mixer of claim 1, further comprising a projection for preventing detachment of the cutting tube and for engaging with the cutting tube, the projection for preventing detachment being formed on an opening inner wall of the stopper.

4. The cap for a contents mixer of claim 1, wherein the stopper is substantially U-shaped.

5. The cap for a contents mixer of claim 4, wherein the stopper has an open-ended square cross section with a lower surface opened.

6. A method for providing a cap for a contents mixer attached to an opening section of a container main body, comprising:

suspending a first contents storage tube, located within a cap main body, from a lower surface of a top wall of the cap main body;

sealing a thin bottom of the first contents storage tube, the thin bottom capable of being opened;

attaching the first contents storage tube to an opening section of the container main body at an inner surface with an engagement section;

blocking a head section of a cutting tube, the cutting tube having a flange section formed at an outer periphery of the head section;

engaging the cutting tube inside the first contents storage tube in a water tight manner and making the cutting tube capable of sliding therein; and interposing a stopper between the flange section of the cutting tube and the tope wall of the cap main body.

7. The method of claim 6, further comprising reducing detachment force of the cap with a projection, the projection contacting a lower surface of said flange and formed on an upper surface of the stopper.

8. The method of claim 6, further comprising preventing detachment of the cutting tube with a projection, the projection engaging with the cutting tube and formed on an opening inner wall of the stopper.

9. The method of claim 6, further comprising making the stopper substantially U-shaped.

10. The method of claim 9, wherein the making the stopper step includes making an open-ended square cross section with a lower surface opened.

* * * * *